US008025151B1

(12) United States Patent
Pertruff

(10) Patent No.: US 8,025,151 B1
(45) Date of Patent: Sep. 27, 2011

(54) CARD SUPPORT SYSTEM

(76) Inventor: Stephen J. Pertruff, Dunedin, FL (US)

( * ) Notice: Subject to any disclaimer, the term of this patent is extended or adjusted under 35 U.S.C. 154(b) by 0 days.

(21) Appl. No.: 12/807,482

(22) Filed: Sep. 7, 2010

(51) Int. Cl.
*B65D 25/54* (2006.01)

(52) U.S. Cl. ..... 206/769; 206/775; 206/39

(58) Field of Classification Search ..... 206/756, 206/763, 764, 769, 775, 776, 779, 781, 39, 206/223
See application file for complete search history.

(56) References Cited

U.S. PATENT DOCUMENTS 5,411,138 A * 5/1995 Klawiter ..... 206/459.1
5,896,991 A * 4/1999 Hippely et al. ..... 206/461
5,919,074 A * 7/1999 Honda ..... 446/268

* cited by examiner

*Primary Examiner* — Jacob K Ackun

(57) ABSTRACT

A primary sheet has a rearward section in a planar configuration and a vertical orientation. The primary sheet has a forward section. The primary sheet is fabricated of an opaque, relatively stiff, paper based material. A horizontal surface has an opening and a horizontal support between the opening and the rearward section. The horizontal support is adapted to receive and support cards. A decorative toy is positioned in the opening. Written indicia are provided on the primary sheet. The written indicia are adapted to be readily seen and read in the vicinity. In this manner customers are attracted.

2 Claims, 7 Drawing Sheets

CARD SUPPORT SYSTEM

BACKGROUND OF THE INVENTION

Field of the Invention

The present invention relates to a card support system and more particularly pertains to holding a plurality of cards adapted to be individually taken by consumers and for presenting indicia and a toy model for attraction purposes, the holding and the presenting being done in an interest-stirring, eye-appealing, convenient and economic manner.

SUMMARY OF THE INVENTION

In view of the disadvantages inherent in the known types of support systems of known designs and configurations now present in the prior art, the present invention provides an improved card support system. As such, the general purpose of the present invention, which will be described subsequently in greater detail, is to provide a new and improved card support system and method which has all the advantages of the prior art and none of the disadvantages.

To attain this, the present invention essentially comprises a card support system. First provided is a primary sheet. The primary sheet has a rearward section. The rearward section is provided in a planar configuration. The rearward section has a vertical orientation. The primary sheet has a forward section. The forward section has a forward extension. The forward section also has lateral extensions. The primary sheet is adapted to be folded into a box-like configuration. The forward section has an upper horizontal surface. The upper horizontal surface has an opening. The forward section forms a reception area. The reception area is provided adjacent to the rearward section. In this manner greeting cards are supported. The primary sheet is fabricated of an opaque, relatively stiff, paper based material.

Provided next is a decorative toy vehicle. The decorative toy vehicle is positioned in the opening. The decorative toy vehicle is adapted to provide eye-appealing, interest-stirring indicia. In this manner consumers are attracted.

Provided last are written indicia on the primary sheet. The indicia are adapted to be readily seen and read in the vicinity. In this manner customers are attracted.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved card support system which has all of the advantages of the prior art support systems of known designs and configurations and none of the disadvantages.

It is another object of the present invention to provide a new and improved card support system which may be easily and efficiently manufactured and marketed.

It is further object of the present invention to provide a new and improved card support system which is of durable and reliable constructions.

An even further object of the present invention is to provide a new and improved card support system which is susceptible of a low cost of manufacture with regard to both materials and labor, and which accordingly is then susceptible of low prices of sale to the consuming public, thereby making such card support system economically available to the buying public.

Even still another object of the present invention is to provide a card support system for holding a plurality of cards adapted to be individually taken by consumers and for presenting indicia and a toy model for attraction purposes, the holding and the presenting being done in an interest-stirring, eye-appealing, convenient and economic manner.

Lastly, it is an object of the present invention to provide a new and improved card support system. A primary sheet has a rearward section in a planar configuration and a vertical orientation. The primary sheet has a forward section. The primary sheet is fabricated of an opaque, relatively stiff, paper based material. A horizontal surface has an opening and a horizontal support between the opening and the rearward section. The horizontal support is adapted to receive and support cards. A decorative toy is positioned in the opening. Written indicia are provided on the primary sheet. The written indicia are adapted to be readily seen and read in the vicinity. In this manner customers are attracted.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
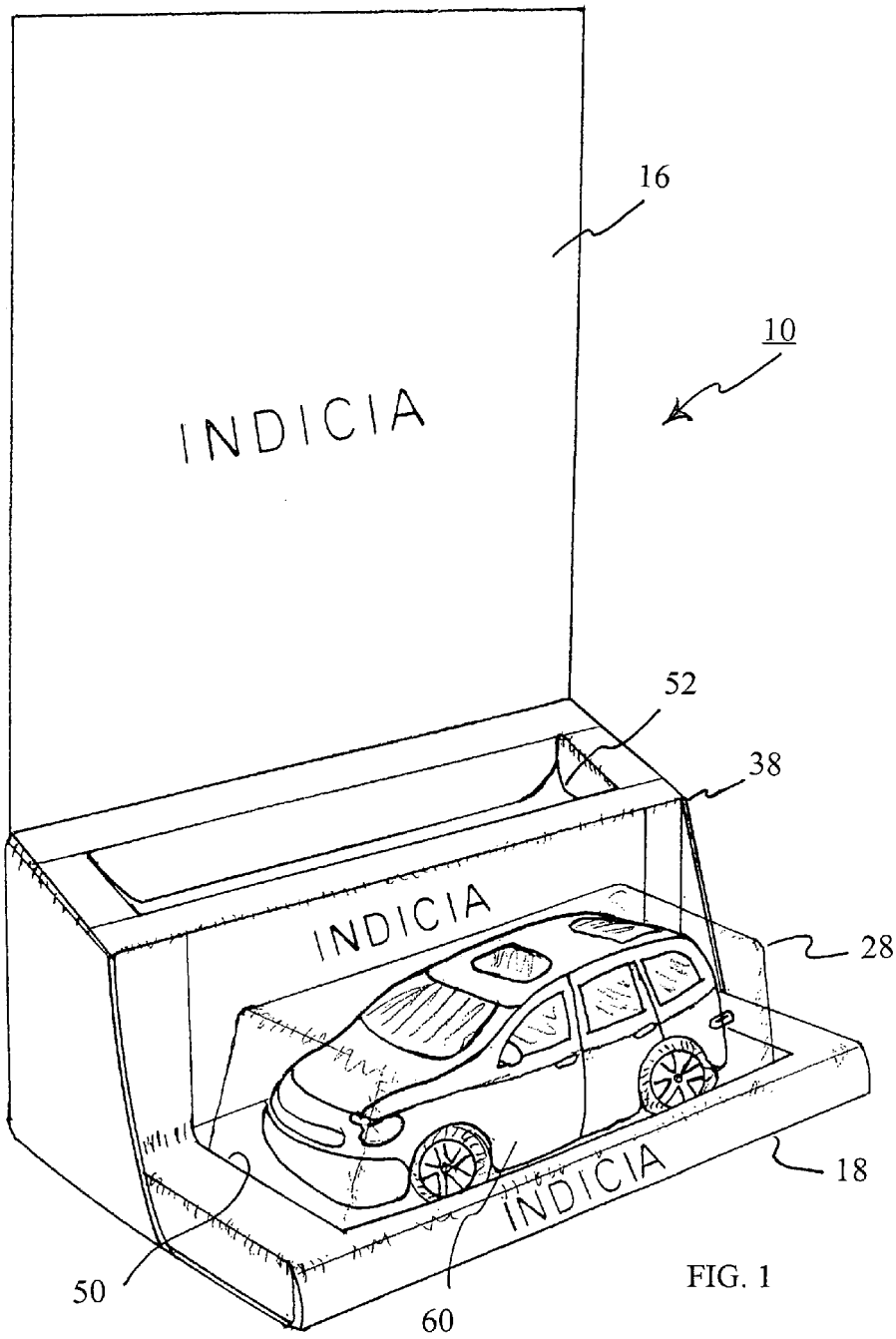
FIG. 1 is a perspective illustration of a business card support system constructed in accordance with the principles of the present invention.
Figure 2A:
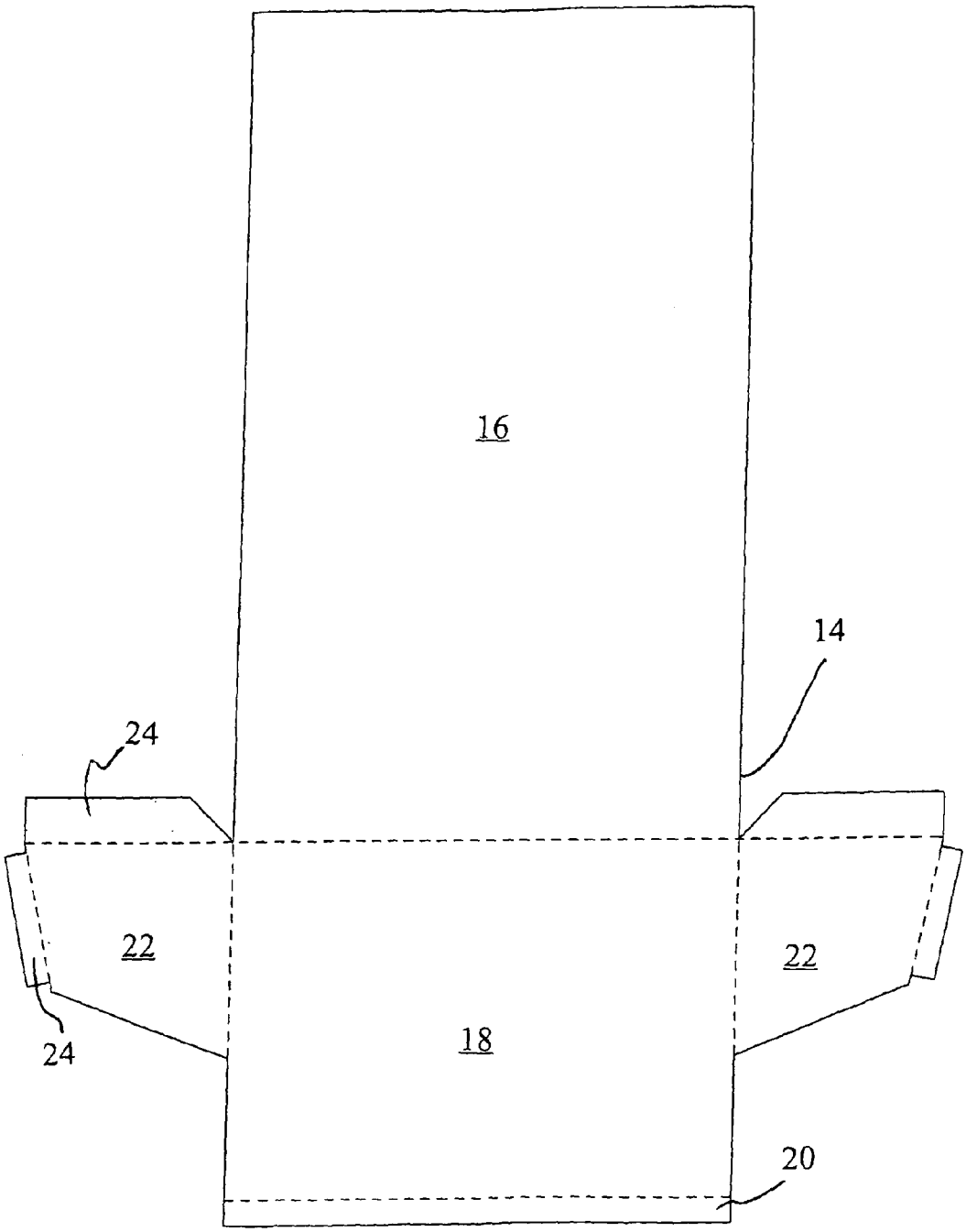
FIGS. 2A, 2B and 2C are plan views of primary, secondary and tertiary sheets adapted to be folded and coupled to form the system of FIG. 1.
Figure 2B:
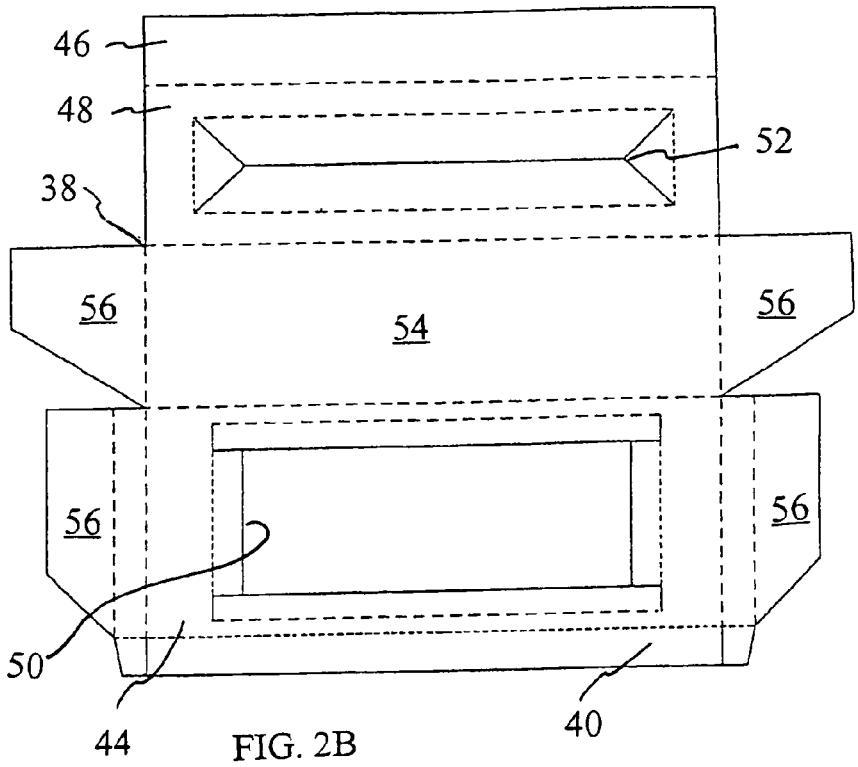
Figure 2C:
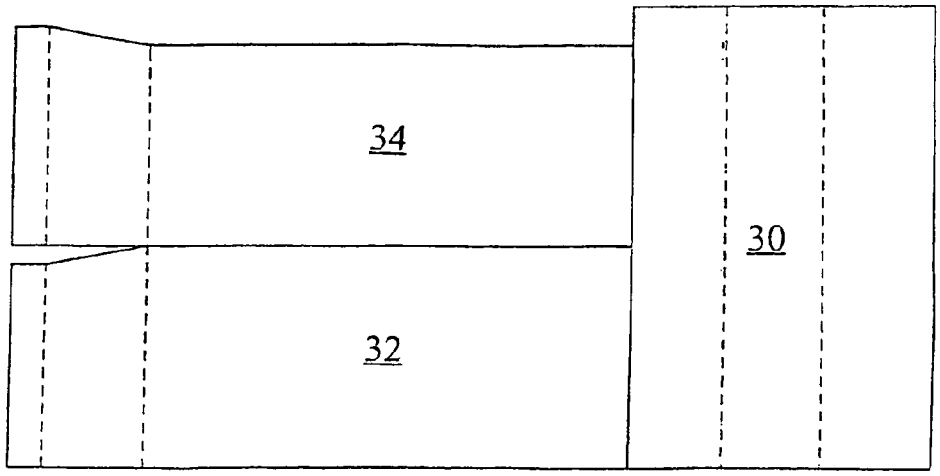
Figures 3A, 3B, 3C, 3D, 3E:
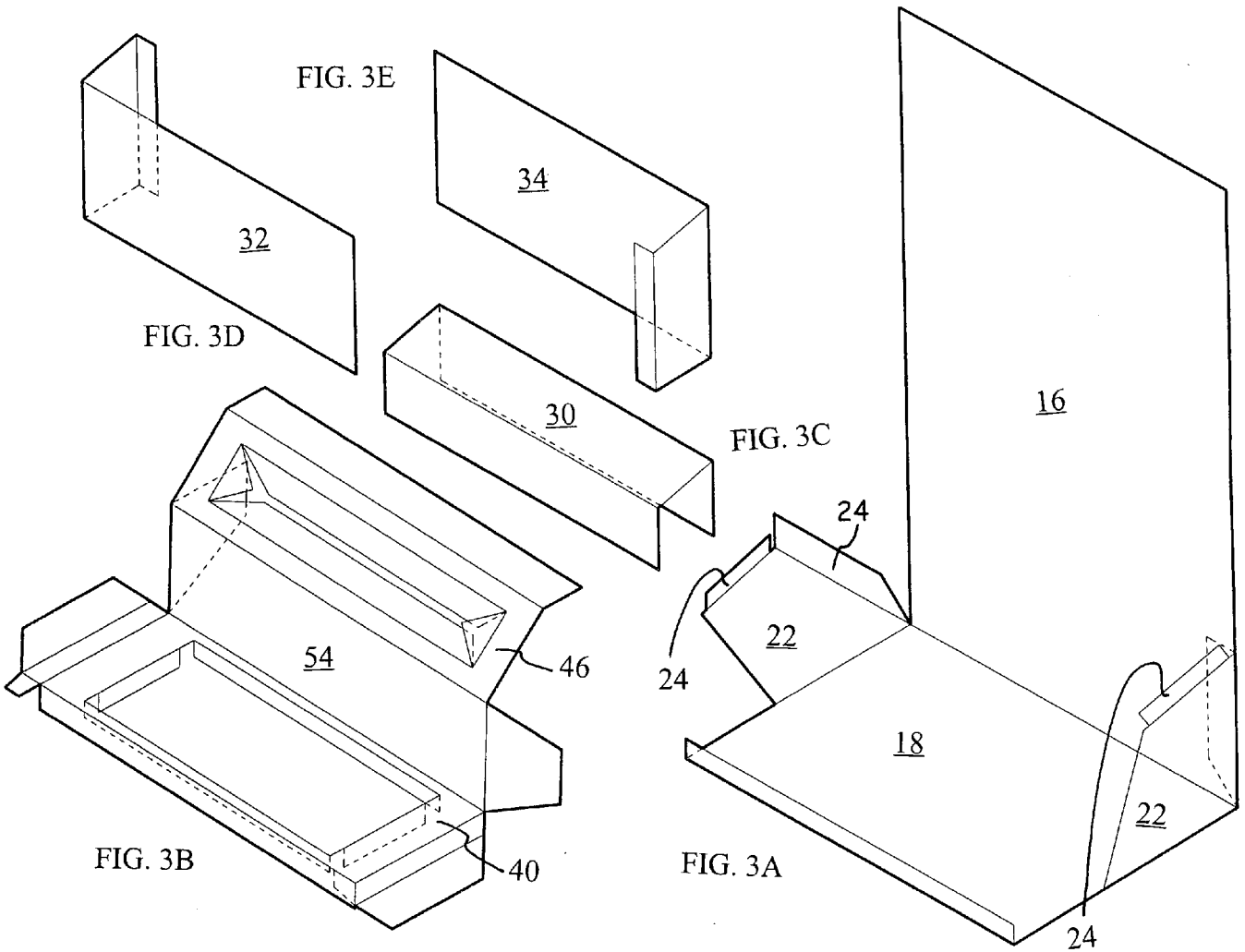
FIGS. 3A, 3B, 3C, 3D and 3E are illustrations of the sheets of FIGS. 2A, 2B and 2C, partially folded prior to being glued into the FIG. 1 orientation.

With reference now to the drawings, and in particular to FIG. 1 thereof, the preferred embodiment of the new and improved card support system embodying the principles and concepts of the present invention and generally designated by the reference numeral 10 will be described.

The present invention, the card support system 10 is comprised of a plurality of components. Such components in their broadest context include a primary sheet, a horizontal surface, a secondary sheet, a decorative toy, and written indicia. Such components are individually configured and correlated with respect to each other so as to attain the desired objective.

The preferred embodiment of the invention is illustrated in FIGS. 1 through 3E. In such embodiment, a primary sheet 14 is provided. The primary sheet has a rearward section 16. The rearward section is provided in a planar configuration. The rearward section has a vertical orientation. The primary sheet has a forward section 18. The forward section is provided in a planar configuration. The forward section is provided in a horizontal orientation. The forward section has a free forward edge. The free forward edge of the forward section has a vertical upturned tab 20. The forward section has side edges. The side edges have vertical upturned sides 22. The side edges have horizontal inturned tabs 24. The primary sheet is fabricated of an opaque, relatively stiff, paper based material.

A secondary sheet is provided. The secondary sheet is shaped into a form of a box. The secondary sheet includes an inverted central U-shaped component 30. The secondary sheet includes a front J-shaped component 32. The secondary sheet also includes a rear J-shaped component 34.

Provided next is a tertiary sheet 38. The tertiary sheet has a forward region 40. The forward region has a horizontal top 44. The horizontal top is provided at a first elevation. The tertiary sheet has a rearward region 46. The rearward region has horizontal top 48. The horizontal top is provided at a second elevation. The secondary sheet in its box-shaped configuration is located beneath the horizontal top of the rearward region. The second elevation is higher than the first elevation. The forward region is positioned over the forward section of the primary sheet adjacent to the free forward edge. The rearward region is positioned over the forward section of the primary sheet adjacent to the rearward section of the primary sheet. The top of the forward region of the tertiary sheet has a rectangular front opening 50. In this manner the secondary sheet is received. The top of the rearward region of the tertiary sheet has a rectangular rear opening 52. The rear opening is adapted to receive a plurality of business cards. The tertiary sheet is fabricated of an opaque, relatively stiff, paper based material. The tertiary sheet has a central region 54. The central region extends vertically between the forward and rearward regions. The central region has side edges. The side edges have inturned tabs 56.

Further provided is a decorative toy vehicle 60. The decorative toy vehicle is positioned in the front opening. The decorative toy vehicle is adapted to provide eye-appealing, interest-stirring indicia. In this manner consumers are attracted. A transparent cover 28 is positioned over the toy vehicle.

Provided last are written indicia on the primary and tertiary sheets. The written indicia are adapted to be readily seen and read in the vicinity. In this manner customers are attracted.

Figure 4:
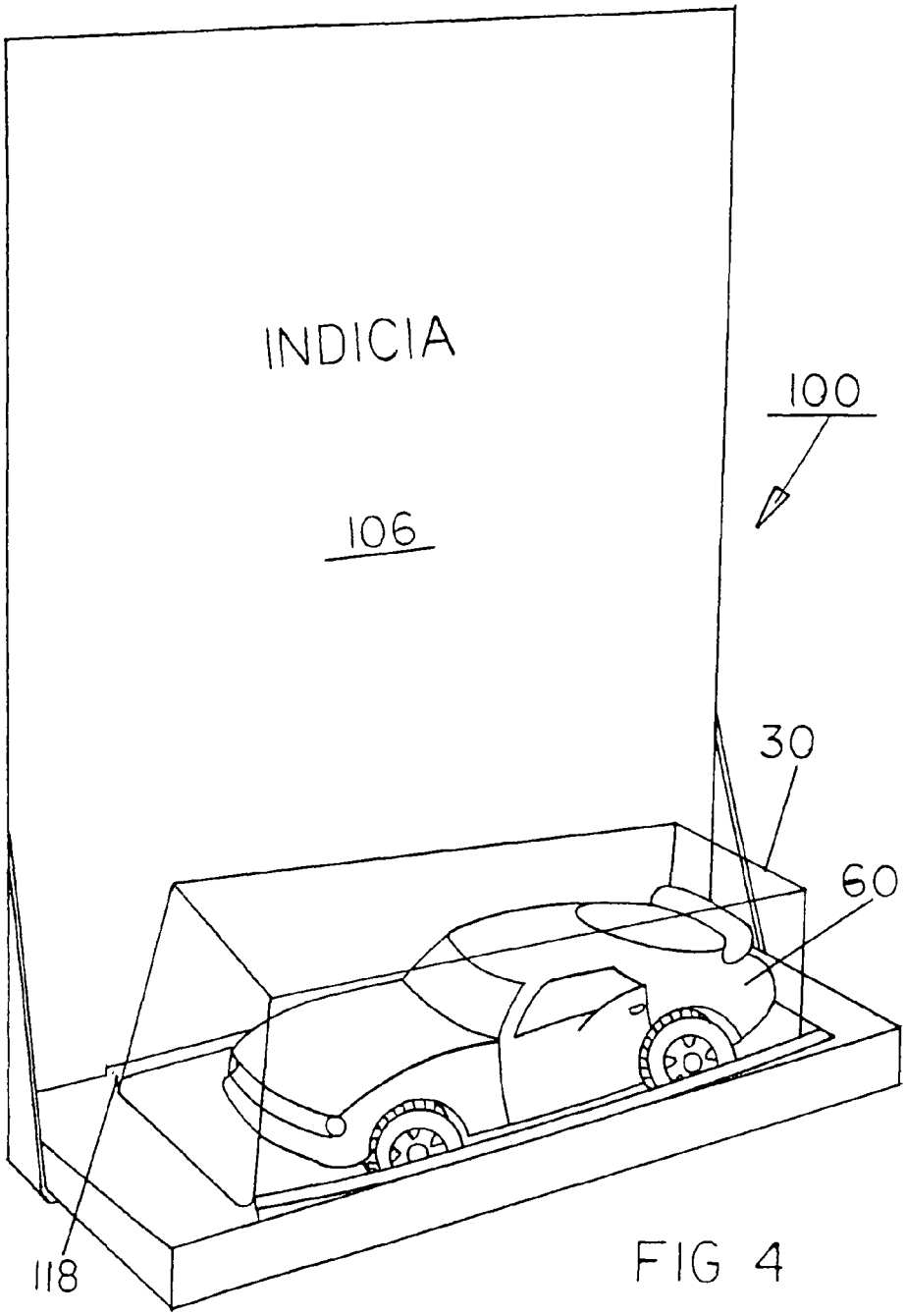
FIG. 4 is a perspective illustration of a greeting card support system constructed in accordance with the principles of the present invention.
Figure 5:
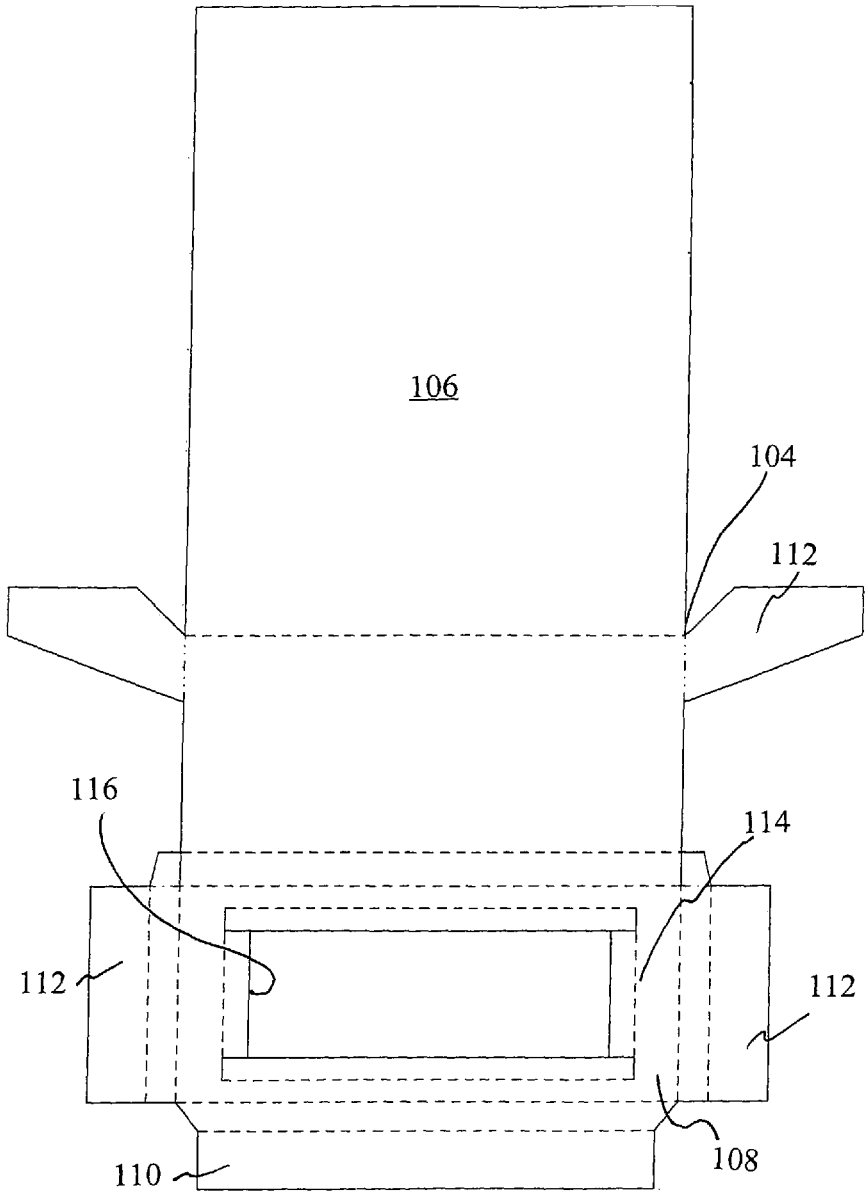
FIG. 5 is a plan view of the primary sheet adapted to be folded and coupled to form the system of FIG. 4.
Figure 6:
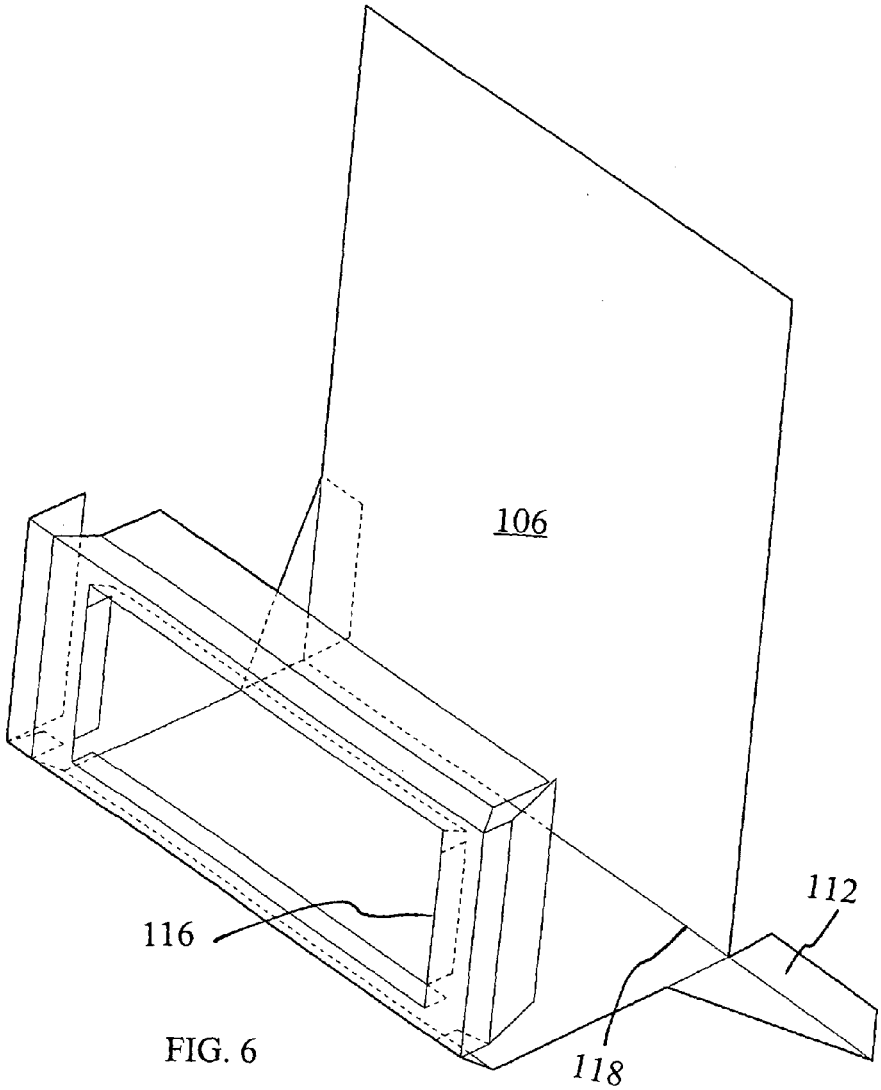
FIG. 6 is an illustration of one sheet of FIG. 5 in partially folded orientations prior to being glued into the FIG. 4 orientation.

FIGS. 4 through 6 illustrate an alternate embodiment 100 of the invention. In such embodiment, first provided is a primary sheet 104. The primary sheet has a rearward section 106. The rearward section is provided in a planar configuration. The rearward section has a vertical orientation. The primary sheet has a forward section 108. The forward section has a forward extension 110. The forward section also has lateral extensions 112. The primary sheet is adapted to be folded into a box-like configuration. The forward section has an upper horizontal surface 114. The upper horizontal surface has an opening 116. The forward section forms a reception area 118. The reception area is provided adjacent to the rearward section. In this manner greeting cards are supported. The primary sheet is fabricated of an opaque, relatively stiff, paper based material.

Provided next is a decorative toy vehicle 60. The decorative toy vehicle is positioned in the opening. The decorative toy vehicle is adapted to provide eye-appealing, interest-stirring indicia. In this manner consumers are attracted. A transparent cover 28 is positioned over the toy vehicle.

Provided last are written indicia on the primary sheet. The indicia are adapted to be readily seen and read in the vicinity. In this manner customers are attracted.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A card support system comprising, in combination:

a primary sheet having a rearward section in a planar configuration and a vertical orientation, the primary sheet having a forward section, the primary sheet being fabricated of an opaque, relatively stiff, paper based material;

a horizontal surface with an opening and a horizontal support between the opening and the rearward section, the horizontal support adapted to receive and support cards;

a decorative toy positioned in the opening; and written indicia on the primary sheet adapted to be readily seen and read; and a tertiary sheet fabricated of an opaque, relatively stiff, paper based material formed forward region and a rearward region, the forward region being positioned over the forward section of the primary sheet remote from the rearward section, the rearward region being positioned over the forward section adjacent to the rearward section, the top of the forward region of the tertiary sheet having a rectangular front opening, the top of the rearward region of the tertiary sheet having a rectangular rear opening adapted to receive a plurality of business cards.

2. A card support system (10) for holding a plurality of business cards adapted to be individually taken by consumers and for presenting indicia and a toy model for attraction purposes, the system comprising, in combination:

a primary sheet (14) having a rearward section (16) in a planar configuration and a vertical orientation, the primary sheet having a forward section (18) in a planar configuration and a horizontal orientation, the forward section having a free forward edge with a vertical upturned tab (20), the forward section having side edges with vertical upturned sides (22) with inturned tabs (24), the primary sheet being fabricated of an opaque, relatively stiff, paper based material;

a secondary sheet shaped into a form of a box and including an inverted central U-shaped component (30) and a front J-shaped component (32) and a rear J-shaped component (34);

a tertiary sheet (38) having a forward region (40) with a horizontal top (44) at a first elevation, the tertiary sheet having a rearward region (46) with a horizontal top (48) at a second elevation, the second elevation being higher than the first elevation, the forward region being positioned over the forward section of the primary sheet adjacent to the free forward edge, the rearward region being positioned over the rearward section of the primary sheet adjacent to the rearward section of the primary sheet, the secondary sheet in its box-shaped configuration being located beneath the horizontal top of the rearward region, the top of the forward region of the tertiary sheet having a rectangular front opening (50), the top of the rearward region of the tertiary sheet having a rectangular rear opening (52) adapted to receive a plurality of business cards, the tertiary sheet being fabricated of an opaque, relatively stiff, paper based material, the tertiary sheet having a central region (54) extending vertically between the forward and rearward regions, the central region having side edges with inturned tabs (56);

a decorative toy vehicle (60) positioned in the front opening, the decorative toy vehicle adapted to provide eye-appealing, interest-stirring indicia for attracting consumers, a transparent cover (28) positioned over the toy vehicle; and written indicia on the primary and tertiary sheets adapted to be readily seen and read in the vicinity for attracting customers.

* * * * *